US012343785B2

(12) United States Patent
Hsu et al.

(10) Patent No.: US 12,343,785 B2
(45) Date of Patent: Jul. 1, 2025

(54) POWER TOOL

(71) Applicant: TECHWAY INDUSTRIAL CO., LTD., Taichung (TW)

(72) Inventors: Chih-Hua Hsu, Taichung (TW); Liang Huan Chen, Taichung (TW)

(73) Assignee: TECHWAY INDUSTRIAL CO., LTD., Taichung (TW)

( * ) Notice: Subject to any disclaimer, the term of this patent is extended or adjusted under 35 U.S.C. 154(b) by 246 days.

(21) Appl. No.: 18/298,504

(22) Filed: Apr. 11, 2023

(65) Prior Publication Data

US 2024/0342786 A1 Oct. 17, 2024

(51) Int. Cl.

| | |
|---|---|
| ***B21J 15/10*** | (2006.01) |
| ***B21J 15/04*** | (2006.01) |
| ***B21J 15/12*** | (2006.01) |
| ***B21J 15/26*** | (2006.01) |

(52) U.S. Cl.

CPC ..... *B21J 15/105* (2013.01); *B21J 15/04* (2013.01); *B21J 15/12* (2013.01); *B21J 15/26* (2013.01)

(58) Field of Classification Search

CPC ..... B21J 15/105; B21J 15/12

See application file for complete search history.

(56) References Cited

U.S. PATENT DOCUMENTS

| | | | | |
|---|---|---|---|---|
| 6,684,470 | B1 | 2/2004 | Joux | |
| 11,292,049 | B2 | 4/2022 | Hsu et al. | |
| 11,325,180 | B2 | 5/2022 | Yabunaka et al. | |
| 2011/0271504 | A1* | 11/2011 | Preti | B21J 15/26 29/243.524 |
| 2016/0114383 | A1 | 4/2016 | Honsel | |
| 2019/0351477 | A1* | 11/2019 | Yabuguchi | B21J 15/045 |
| 2020/0139424 | A1* | 5/2020 | Yabuguchi | B21J 15/26 |
| 2020/0238489 | A1* | 7/2020 | Mori | B25B 27/0014 |
| 2021/0379646 | A1* | 12/2021 | Killen | B21J 15/105 |
| 2021/0394254 | A1* | 12/2021 | Yabunaka | B21J 15/105 |
| 2022/0176528 | A1* | 6/2022 | Gendre | B21J 15/06 |
| 2023/0030692 | A1* | 2/2023 | Johnson | B25B 27/0014 |
| 2023/0074463 | A1 | 3/2023 | His et al. | |

(Continued)

FOREIGN PATENT DOCUMENTS

| | | | |
|---|---|---|---|
| CN | 104999410 | A | 10/2015 |
| CN | 113829282 | A | 12/2021 |

(Continued)

*Primary Examiner* — Kyle A Cook

(74) *Attorney, Agent, or Firm* — Best & Flanagan LLP

(57) ABSTRACT

A power tool has a body, a trigger, a motor, a shaft set, a ball screw, and a pre-fastening module. The pre-fastening module has a first pre-fastening detecting member and a second pre-fastening detecting member. The first pre-fastening detecting member is moved with a connecting shaft of the shaft set in an axial direction. The second pre-fastening detecting member is located on a moving path of the ball screw. When a threaded spindle of the shaft set is inserted in a rivet nut and the connecting shaft is pressed to move inward the body, the first pre-fastening detecting member is moved to align with the second pre-fastening detecting member, and the motor is started automatically to drive the threaded spindle to rotate relative to the rivet nut. The motor will be stopped automatically after the rivet nut is pre-fastened on the threaded spindle, and this is convenient in use.

10 Claims, 11 Drawing Sheets

(56) References Cited

U.S. PATENT DOCUMENTS

| | | | | |
|---|---|---|---|---|
| 2023/0271307 | A1* | 8/2023 | Vollmer | B21J 15/26 72/391.4 |
| 2023/0294162 | A1* | 9/2023 | Yabuguchi | B21J 15/105 227/61 |

FOREIGN PATENT DOCUMENTS

| | | | |
|---|---|---|---|
| DE | 102014108398 | B4 | 12/2016 |
| DE | 202022103657 | U1 | 8/2023 |
| DE | 102022116431 | A1 | 1/2024 |
| EP | 3202536 | A1 | 8/2017 |
| EP | 2786843 | B1 | 9/2019 |
| EP | 3674037 | A1 | 7/2020 |
| EP | 3511089 | B1 | 11/2021 |
| TW | I580494 | B | 5/2017 |
| TW | I745048 | B | 11/2021 |
| WO | WO2016086844 | A1 | 6/2016 |
| WO | WO2021160868 | A1 | 8/2021 |

* cited by examiner

POWER TOOL

BACKGROUND OF THE INVENTION

1. Field of the Invention

The present invention relates to a power tool, and more particularly to a power tool that can be used for rivet nuts conveniently.

2. Description of Related Art

Rivet nuts are used to connect two objects by deformation after compressed, can be used easily, have high structural strength, and are widely used in the fields of automobiles and aviation.

Each rivet nut has a threaded portion and a deformed portion. During operation, the rivet nut is pre-fastened on a spindle of a conventional power tool, and then the deformed portion of the rivet nut is deformed by a moving stroke of the spindle, so that the rivet nut is fastened on an object. However, a trigger of the conventional power tool needs to be pressed twice to perform the pre-fastening step and deforming step of the rivet nut respectively, and this is inconvenient in use.

To overcome the shortcomings, the present invention provides a power tool to mitigate or obviate the aforementioned problem.

SUMMARY OF THE INVENTION

The main objective of the present invention is to provide a power tool that can be used for rivet nuts conveniently.

The power tool in accordance with the present invention has a body, a trigger, a motor, a shaft set, a ball screw, and a pre-fastening module. The pre-fastening module has a first pre-fastening detecting member and a second pre-fastening detecting member. The first pre-fastening detecting member is moved with a connecting shaft of the shaft set in an axial direction. The second pre-fastening detecting member is located on a moving path of the ball screw. When a threaded spindle of the shaft set is inserted in a rivet nut and the connecting shaft is pressed to move inward the body, the first pre-fastening detecting member is moved to align with the second pre-fastening detecting member, and the motor is started automatically to drive the threaded spindle to rotate relative to the rivet nut. The motor will be stopped automatically after the rivet nut is pre-fastened on the threaded spindle, and this is convenient in use.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
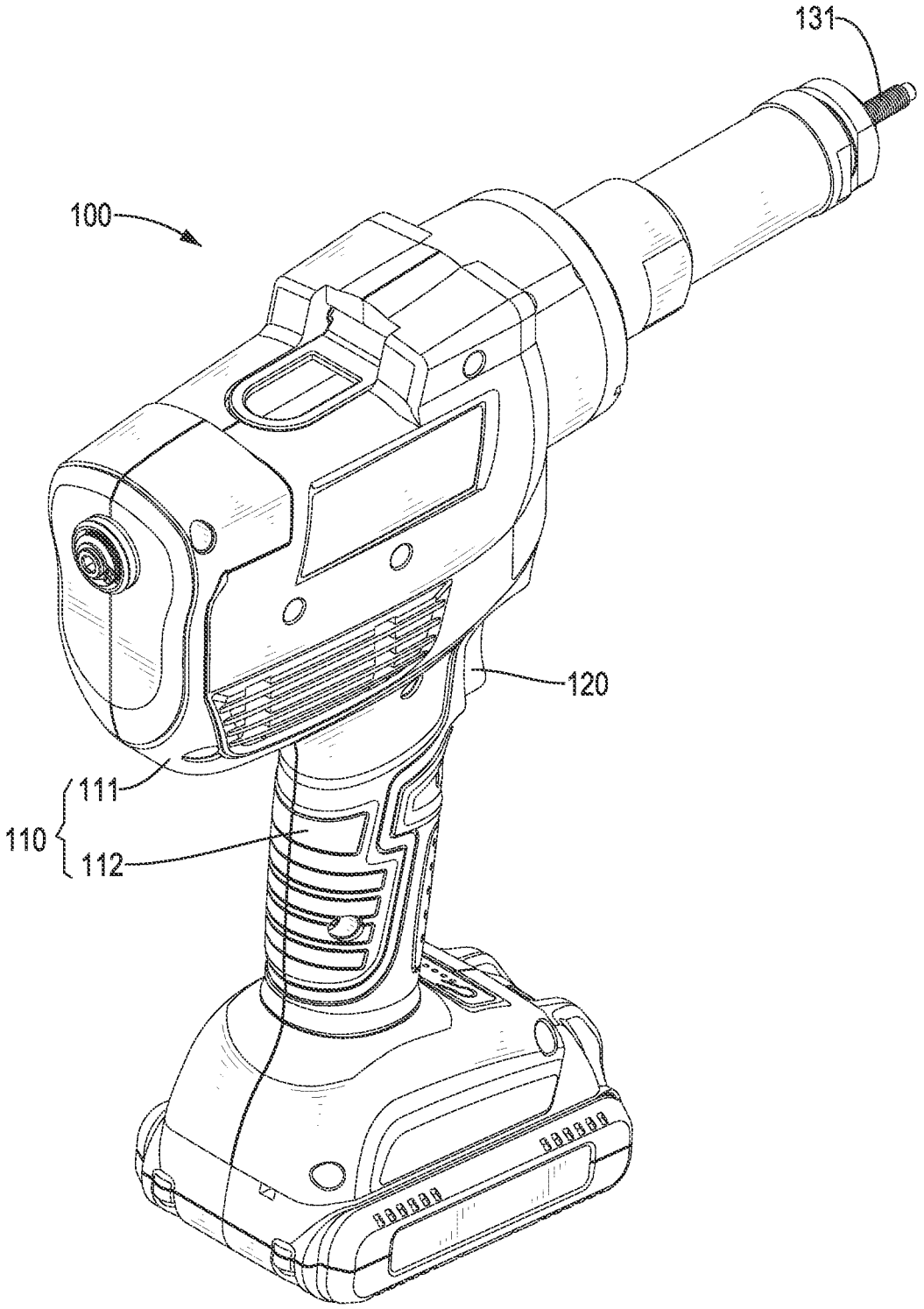
FIG. 1 is a perspective view of a power tool in accordance with the present invention.

Embodiments of the present invention will be described below with reference to the drawings. For clarity, many practical details are included in the following narrative. However, the reader should understand that these practical details should not be used to limit the present invention. That is, in some embodiments of the present invention, these practical details are unnecessary. In addition, for simplifying the drawings, some well-known and commonly used structures and elements will be shown in a simple and schematic manner in the drawings, and repeated elements may be represented by the same or similar numbers.

In addition, terms such as first, second, and third are only used to describe different elements or components, and there is no limitation to the elements/components themselves. Therefore, the first elements/components can also be renamed as the second elements/components. Furthermore, the combination of elements/components/mechanisms/modules in the present invention is not a combination that is generally known, routine or conventional in this field, and whether the elements/components/mechanisms/modules are known or not, cannot be used to determine whether the combination relationship is easily accomplished by persons of ordinary skill in the technical field.

With reference to FIGS. 1 to 3, 3A, and 3B, a power tool 100 in accordance with the present invention is used for a rivet nut N1 and has a body 110, a trigger 120, a motor 140, a shaft set 130, a ball screw 150, and a pre-fastening module 170.

The trigger 120 is disposed on the body 110, and the motor 140 is disposed in the body 110. The shaft set 130 is disposed in the body 110, is driven by the motor 140, and has an axial direction I1, a threaded spindle 131, and a connecting shaft 132. The threaded spindle 131 has at least one part extended out of the body 110 to screw with the rivet nut N1, and the connecting shaft 132 is connected to the threaded spindle 131 to transmit a rotational driving force of the motor 140. The ball screw 150 is mounted around the connecting shaft 132. Please note in the present invention, "mount around" to dispose on an outside of an object, and "insert" means to insert into an inside of an object.

The pre-fastening module 170 has a first pre-fastening detecting member 171 and a second pre-fastening detecting member 172. The first pre-fastening detecting member 171 and the connecting shaft 132 are moved together in the axial direction I1. The second pre-fastening detecting member 172 is located on a moving path of the ball screw 150. With reference to FIGS. 3, 3A, 4, and 4A, when the threaded spindle 131 is inserted into the rivet N1 and is pressed to enable the connecting shaft 132 to move toward an interior of the body 110, the first pre-fastening detecting member 171 is moved with the connecting shaft 132 to trigger the second pre-fastening detecting member 172. Then the motor 140 automatically starts and drives the threaded spindle 131 to rotate relative to the rivet nut N1, and the motor 140 stops automatically after the rivet nut N1 is pre-fastened on the threaded spindle 131.

In this way, the motor 140 can be automatically turned on via a detection of the pre-fastening module 170 to complete the pre-fastening process of the rivet nut N1, the motor 140 will be automatically stopped after the pre-fastening process is completed, and this can improve the convenience of use, can reduce the structural complexity, and can reduce the cost. Details of the power tool 100 will be described later.

Figure 2:
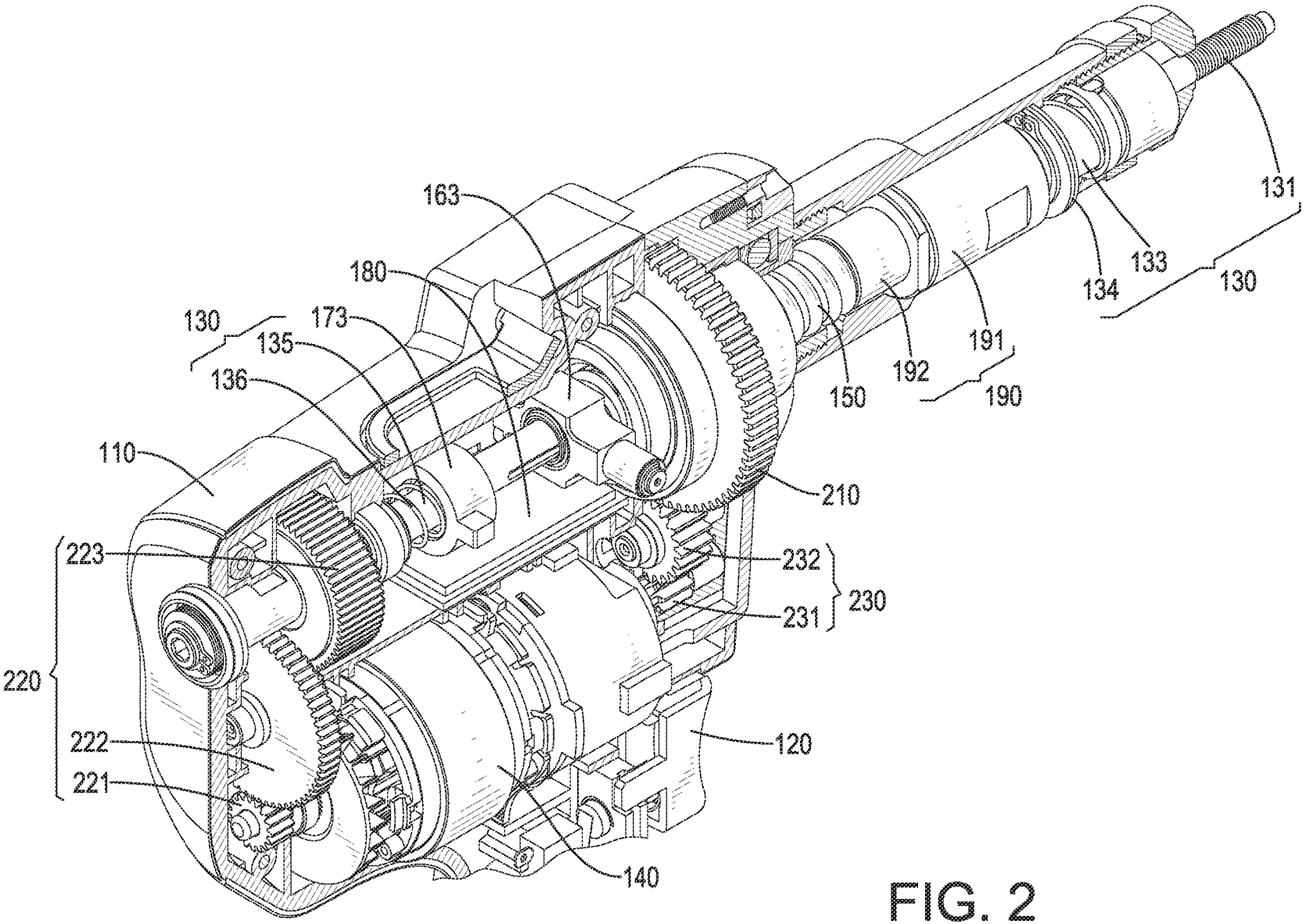
FIG. 2 is an enlarged and exploded perspective view in partial section of the power tool in FIG. 1.
Figure 3:
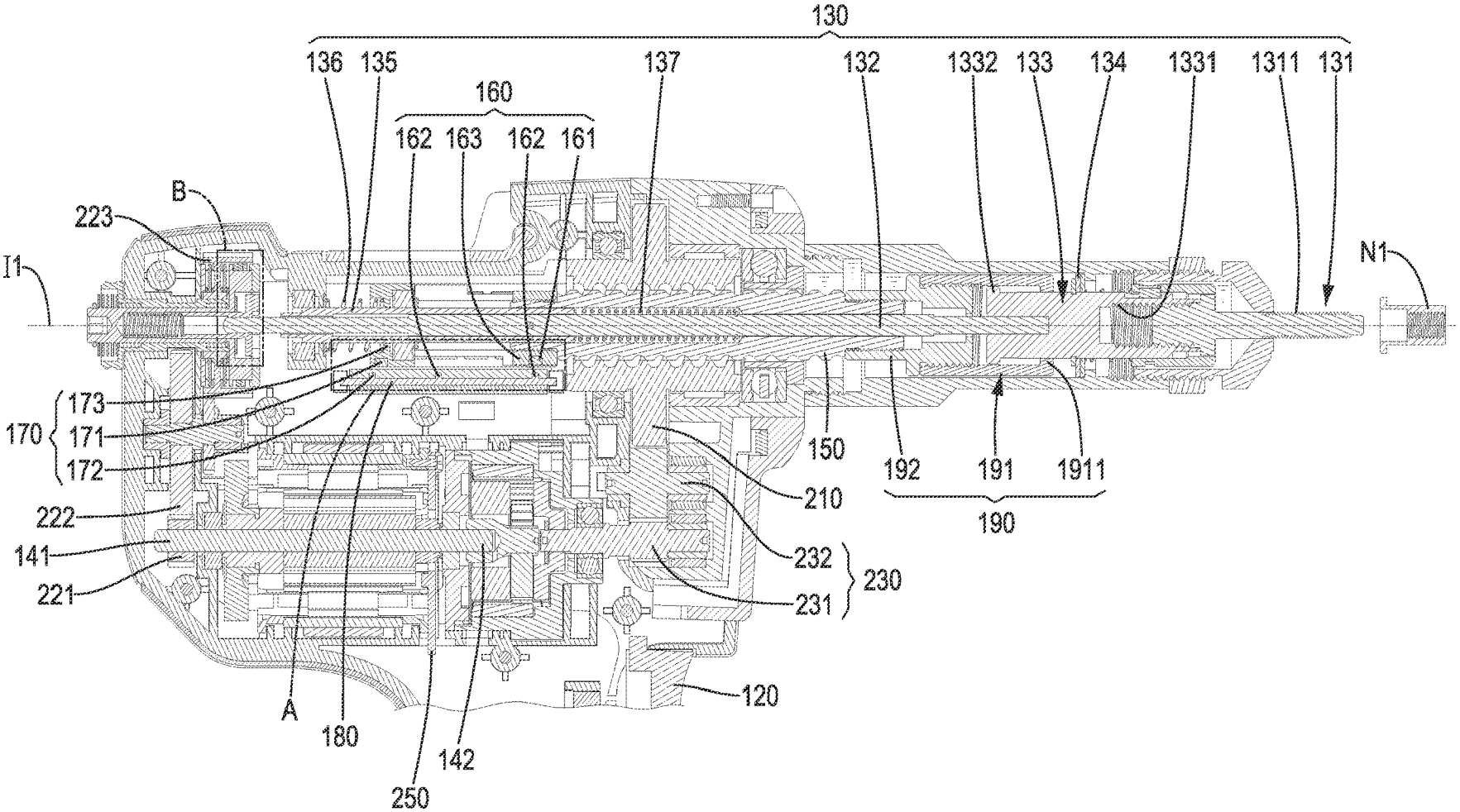
FIG. 3 is an enlarged cross sectional side view of the power tool in FIG. 1.

With reference to FIGS. 1 to 3, the body 110 of the power tool 100 may have a barrel 111 and a handle 112. The handle 112 is connected to the barrel 111 to form a gun shape of the body 110. The trigger 120 is disposed on the handle 112, and the motor 140, the shaft set 130, the ball screw 150, the position sensing module 160, and the pre-fastening module 170 are all disposed in the barrel 111.

With reference to FIGS. 2 and 3, the threaded spindle 131 has a first threaded end 1311 and a second threaded end respectively disposed on two opposite ends of the threaded spindle 131. The first threaded end 1311 extends through and out of a muzzle of the barrel 111 to connect with the rivet nut N1. The second threaded end of the threaded spindle 131 is disposed in the barrel 111. The shaft set 130 further has a pulling shaft 133 and a limiting buckle 134. The pulling shaft 133 is disposed in the barrel 111, is connected between the threaded spindle 131 and the connecting shaft 132, and has a front end, a rear end, a threaded hole 1331 and an inserting hole. The threaded hole 1331 is formed in the front end of the pulling shaft 133 and is screwed with the second threaded end of the threaded spindle 131. The inserting hole is formed in the rear end of the pulling shaft 133 and is mounted around the connecting shaft 132. The limiting buckle 134 is mounted around the pulling shaft 133 to limit a starting point of a stroke of the pulling shaft 133 in the axial direction I1. The connecting shaft 132 has a cross section being hexagonal, and the inserting hole has a shape that corresponds to and matches with the cross section of the connecting shaft 132. Then the pulling shaft 133 can be driven by the connecting shaft 132 to rotate the threaded spindle 131, and can allow the connecting shaft 132 to move in the axial direction I1 relative to the pulling shaft 133.

With reference to FIGS. 2 and 3, the shaft set 130 may further have a spring sleeve 135, a first spring 136, and a second spring 137. The spring sleeve 135 is mounted around the connecting shaft 132, the first spring 136 is mounted around the spring sleeve 135, and the second spring 137 is mounted around the connecting shaft 132, and abuts against the spring sleeve 135 and an inner flange of the ball screw 150.

With reference to FIGS. 2 and 3, the power tool 100 may further have a linkage set 190. The linkage set 190 has a limiting mount 191 and a fixed sleeve 192. The rear end of the pulling shaft 133 extends into the limiting mount 191, and the limiting mount 191 has a radial flange 1911 formed in the limiting mount 191 and corresponding to a flange 1332 of the pulling shaft 133. The fixed sleeve 192 is securely connected to the limiting mount 191 opposite to the pulling shaft 132, and is mounted around the ball screw 150 and the connecting shaft 132. The ball screw 150 has a first end screwed with the fixed sleeve 192. Under the above-mentioned structural configuration, the linkage set 190 and the ball screw 150 can be moved together in the axial direction I1, the connecting shaft 132 is allowed to move relative to the ball screw 150 in the axial direction I1 inside the ball screw 150, and the connecting shaft 132 is allowed to rotate relative to the ball screw 150.

Figure 3A:
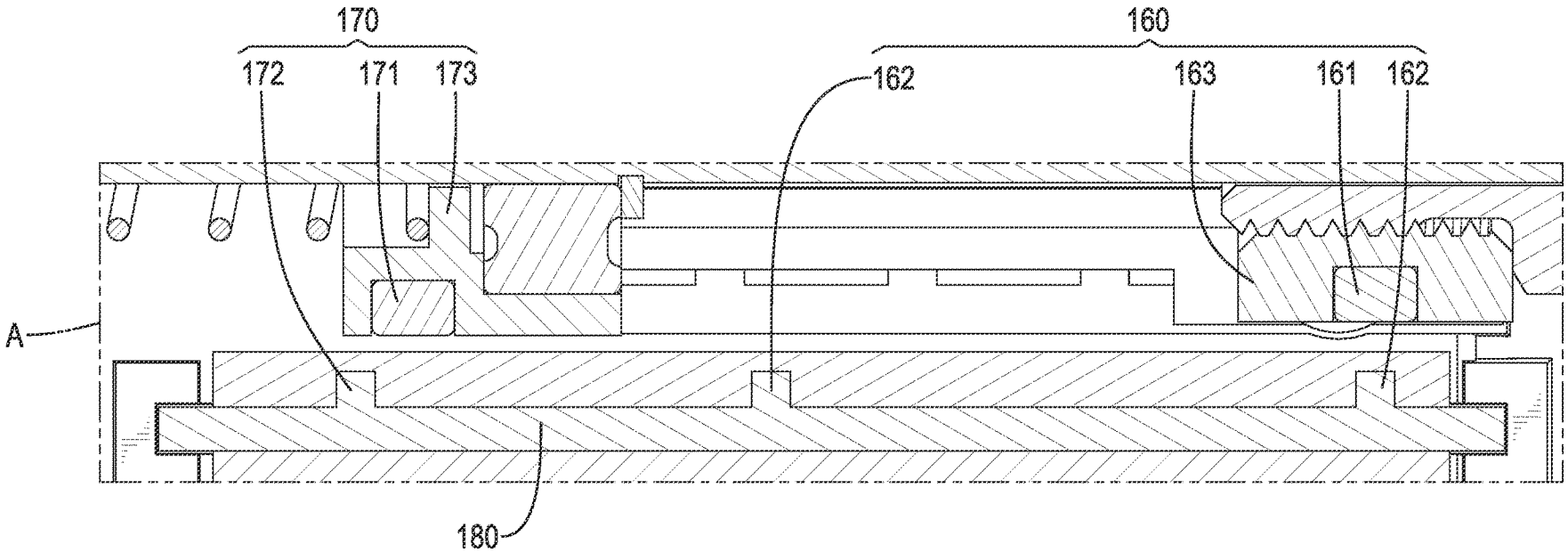
FIG. 3A is a further enlarged cross sectional side view of the power tool in FIG. 3 at a rectangular area A.

With reference to FIGS. 3 and 3A, the power tool 100 may further have a position sensing module 160, and the position sensing module 160 has a first position-sensing element 161 and at least one second position-sensing element 162. The first position-sensing element 161 can be moved with the ball screw 150 in the axial direction I1. The at least one second position-sensing element is located on the moving path of the ball screw 150 and is used to sense the first position-sensing element 161 to confirm the position of the ball screw 150. When the trigger 120 is pressed by a user, the motor 140 is started, the threaded spindle 131 pulls the rivet nut N1 to be fixed on an object and withdraws from the rivet nut N1, and the ball screw 150 moves to align the first position-sensing element 161 with the at least one second position-sensing element 162, confirm that the ball screw 150 returns to an original position, and the motor 140 stops automatically. In this way, after the rivet nut N1 is fastened on the object, the motor 140 can be stopped by the position sensing module 160.

With reference to FIGS. 3 and 3A, the position sensing module 160 may further have a position-sensing ring 163, and the position-sensing ring 163 is screwed on the ball screw 150 for disposing the first position-sensing element 161. Preferably, the position-sensing ring 163 is screwed on a second end of the ball screw 150 opposite to the first end of the ball screw 150. The pre-fastening module 170 further has a pre-fastening detecting ring 173 mounted around the connecting shaft 132 for disposing the first pre-fastening detecting member 171. Preferably, the pre-fastening detecting ring 173 is mounted around the spring sleeve 135 and is moved together with the spring sleeve 135. The first spring 136 abuts between the pre-fastening detecting ring 173 and a bearing, and the bearing is mounted around the connecting shaft 132 and is connected securely to the body 110.

Figure 3B:
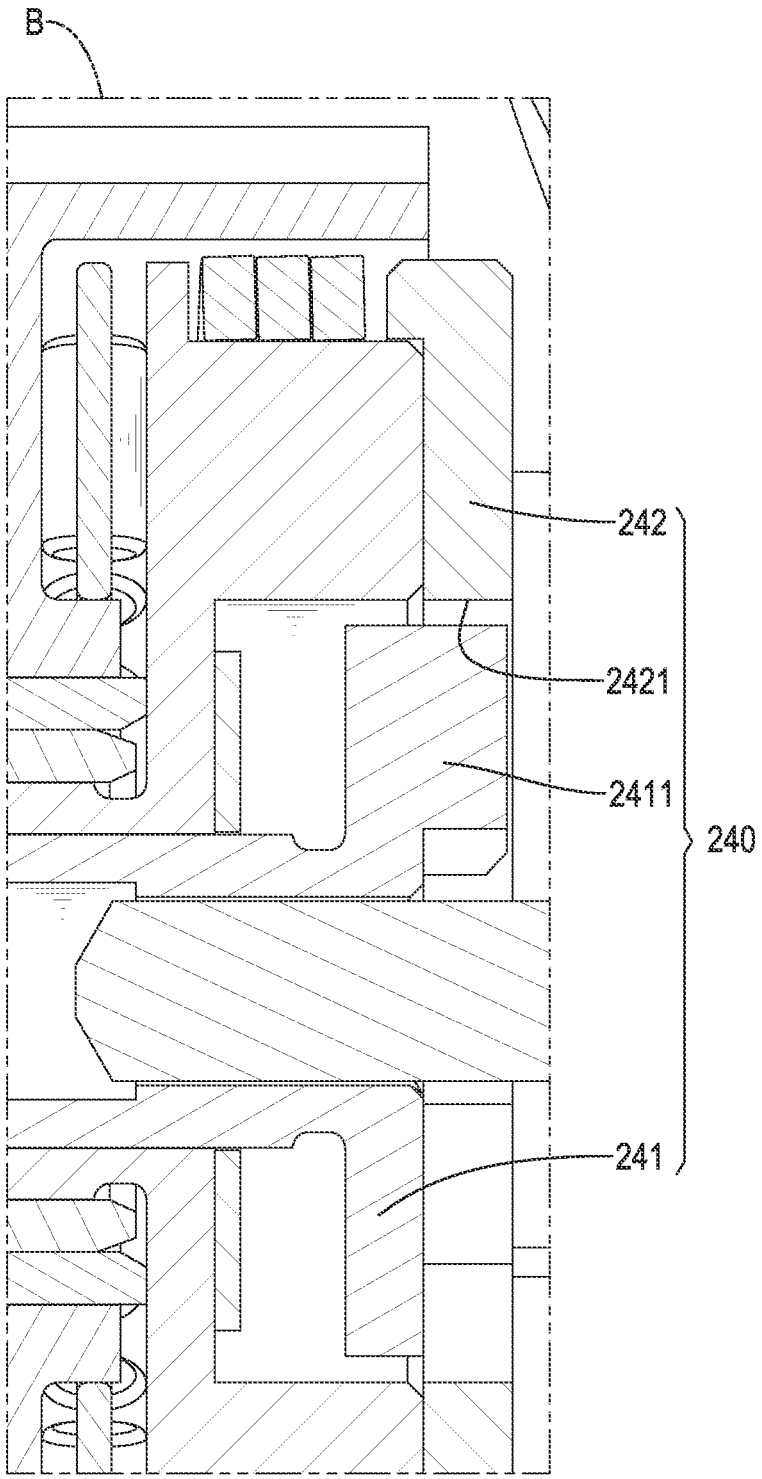
FIG. 3B is a further enlarged cross sectional side view of the power tool in FIG. 3 at a rectangular area B.

With reference to FIGS. 3, 3A, and 3B, each of the first position-sensing element 161 and the first pre-fastening detecting member 171 has a magnet structure, and each of the at least one second position-sensing element 162 and the second pre-fastening detecting member 172 has a Hall element structure. Additionally, the power tool 100 further has a mounting board 180 disposed in the body 110 below the connecting shaft 132. The at least one second position-sensing element 162 and the second pre-fastening detecting member 172 are disposed on the mounting board 180 at spaced intervals. Furthermore, the second pre-fastening detecting member 172 is farther away from the threaded spindle 131 in the axial direction I1 than the at least one second position-sensing element 162. In addition, the position sensing module 160 has two said second position-sensing elements 162, the two said second position-sensing elements 162 are disposed on the mounting board 180 at a spaced interval, and the second pre-fastening detecting member 172 is farther away from the threaded spindle 131 in the axial direction I1 than the two said second position-sensing elements 162. In more detail, the mounting board 180 may be a circuit board structure and can provide electric power to the Hall element structure of the at least one second position-sensing element 162 and the second pre-fastening detecting member 172 to electrically connect to a control circuit. When the first pre-fastening detecting member 171 is moved and is detected by the second pre-fastening detecting member 172, the second pre-fastening detecting member 172 sends a signal to the control circuit to start the motor 140. Similarly, when the first position-sensing element 161 is moved and is detected by any one of the at least one second position-sensing element 162, the corresponding second position-sensing element 162 sends a signal to the control circuit to stop the motor 140.

With reference to FIGS. 2 and 3, the power tool 100 further has a ball nut 210 disposed in the body 110, mounted around the ball screw 150, and disposed between the position-sensing ring 163 and the threaded spindle 131. The power tool 100 further has a shaft-driven gear set 220 and a nut-driven gear set 230. The shaft-driven gear set 220 is disposed in the body 110 and is connected to the connecting shaft 132. The nut-driven gear set 230 is disposed in the body 110 and is connected to the ball nut 210. The motor 140 has two output ends 141, 142, respectively a first output end 141 and a second output end 142, the first output end 141 is connected to the shaft-driven gear set 220, and the second two output end 142 is connected to the nut-driven gear set 230.

Preferably, the nut-driven gear set 230 has an output gearwheel 231 and a transmission gearwheel 232. The output gearwheel 231 is connected to the first output end 141 of the motor 140. The transmission gearwheel 232 engages between the output gearwheel 231 and the ball nut 210. The shaft-driven gear set 220 has a first gearwheel 221, a second gearwheel 222, and a third gearwheel 223. The first gearwheel 221 is mounted around the first output end 141 and is driven by the first output end 141 to rotate. The second gearwheel 222 has a main gear portion and an auxiliary gear portion, and the main gear portion of the second gearwheel 222 engages with the first gearwheel 221. The third gearwheel 223 is mounted around the connecting shaft 132 and engages with the auxiliary gear portion of the second gearwheel 222.

With reference to FIGS. 3 and 3B, the power tool 100 further has a clutch 240. The clutch 240 is disposed in the body 110 and has a joint bushing 241 and a blocking slice 242. The joint bushing 241 is mounted around the connecting shaft 132, is limited in rotation with the connecting shaft 132, and has an engaging block 2411. The blocking slice 242 is mounted around the joint bushing 241, is rotated with the shaft-driven gear set 220, and has an engaging hole 2421 corresponding to the engaging block 2411. When the engaging block 2411 engages with the engaging hole 2421, the motor 140 drives the shaft-driven gear set 222 to rotate the connecting shaft 132 via the blocking slice 242 and the joint bushing 241 to enable the threaded spindle 131 to rotate to pre-fasten or withdraw the rivet nut N1.

The blocking slice 242 may be securely mounted on the third gearwheel 232 to rotate with the third gearwheel 232. The joint bushing 241 is rotatably connected to the connecting shaft 132. Whether the connecting shaft 132 is to be rotated in conjunction with the third gearwheel 223 can be determined by the joint bushing 241 engaging with or disengaging from the blocking slice 242.

In addition, with reference to FIG. 3, the power tool 100 further has a rotor-position sensor 250 to detect the number of revolutions of the motor 140. When the motor 140 rotates for a preset number of revolutions, the motor 140 stops automatically to complete the pre-fastening process of the rivet nut N1. The rotor-position sensor 250 may have a circuit board and a Hall element, or may have a counter emf circuit to detect the number of revolutions of the motor 140. The rotor-position sensor 250 is conventional and the features and the structures of the rotor-position sensor 250 are not to be described in detail. The number of revolutions of the motor 140 can be converted into the number of rotations of the threaded spindle 131 to know whether it is completely fastened into the rivet nut N1, so the motor 140 can be automatically stopped by setting the preset number of revolutions, and this can improve the convenience of use.

With reference to FIGS. 4, 4A, 4B, 5, 5A, and 5B, further reference to FIGS. 2 and 3, in the initial state as shown in FIGS. 3 and 3B, the first pre-fastening detecting member 171 misaligns with the second pre-fastening detecting member 172, and a gap is formed between the pulling shaft 133 and the limiting mount 191 in the axial direction I1.

Figure 4:
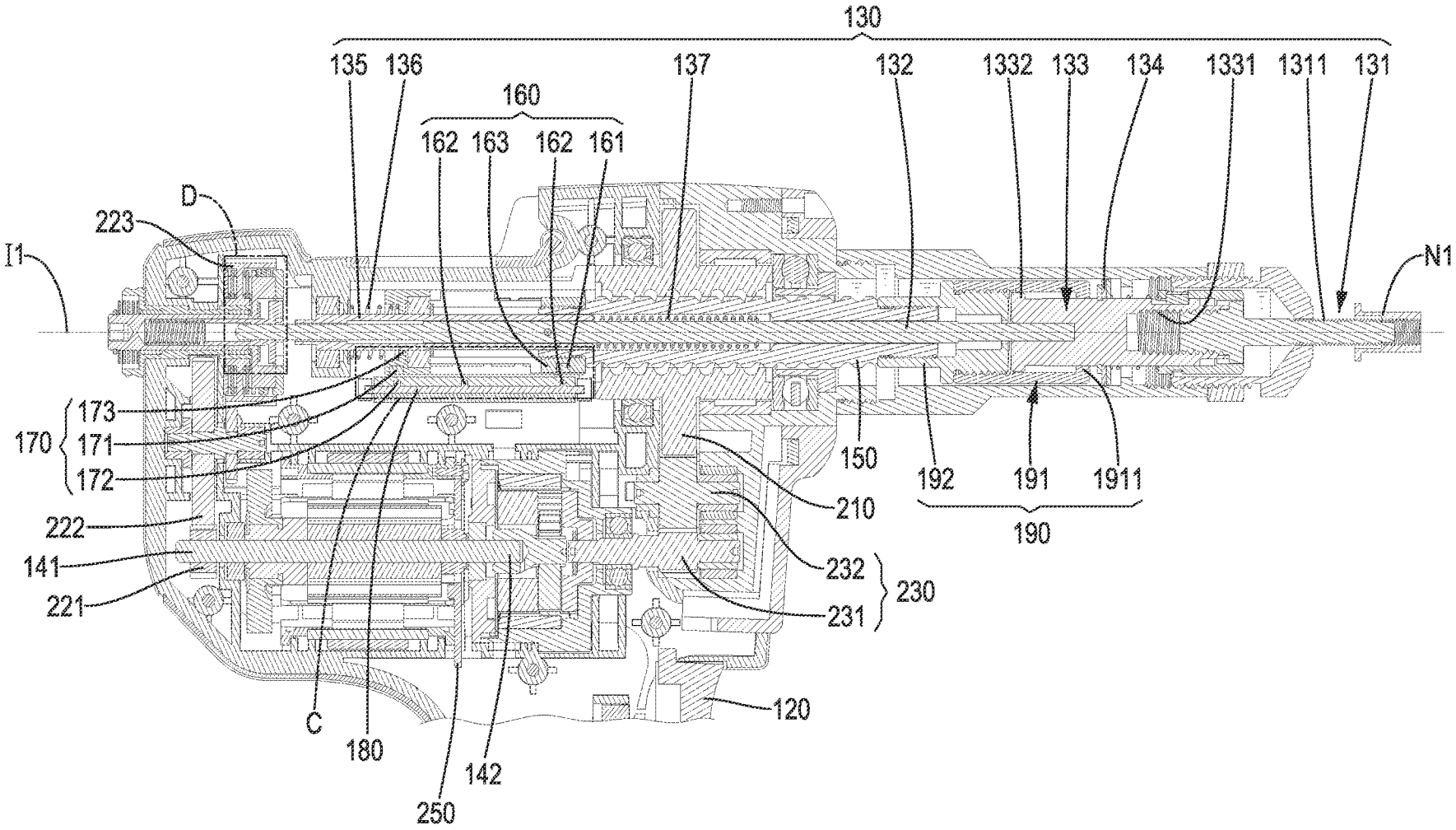
FIG. 4 is an enlarged and operational cross sectional side view of the power tool in FIG. 1.
Figure 4A:
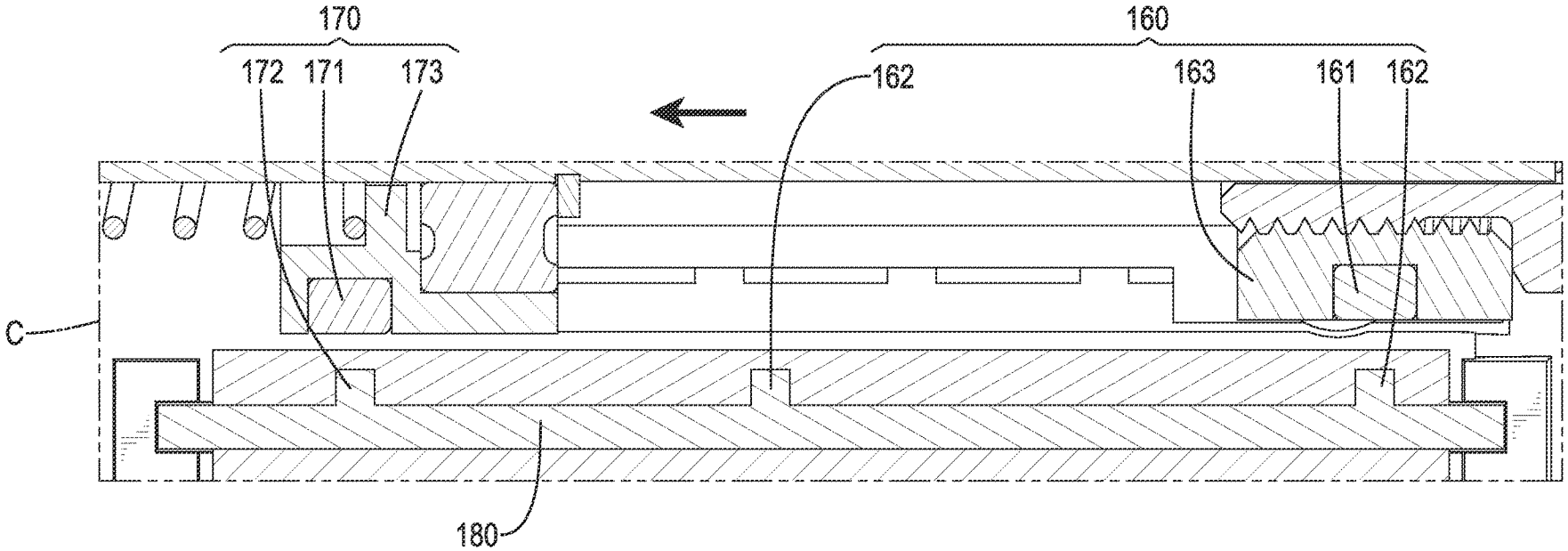
FIG. 4A is a further enlarged and operational cross sectional side view of the power tool in FIG. 4 at a rectangular area C.
Figure 4B:
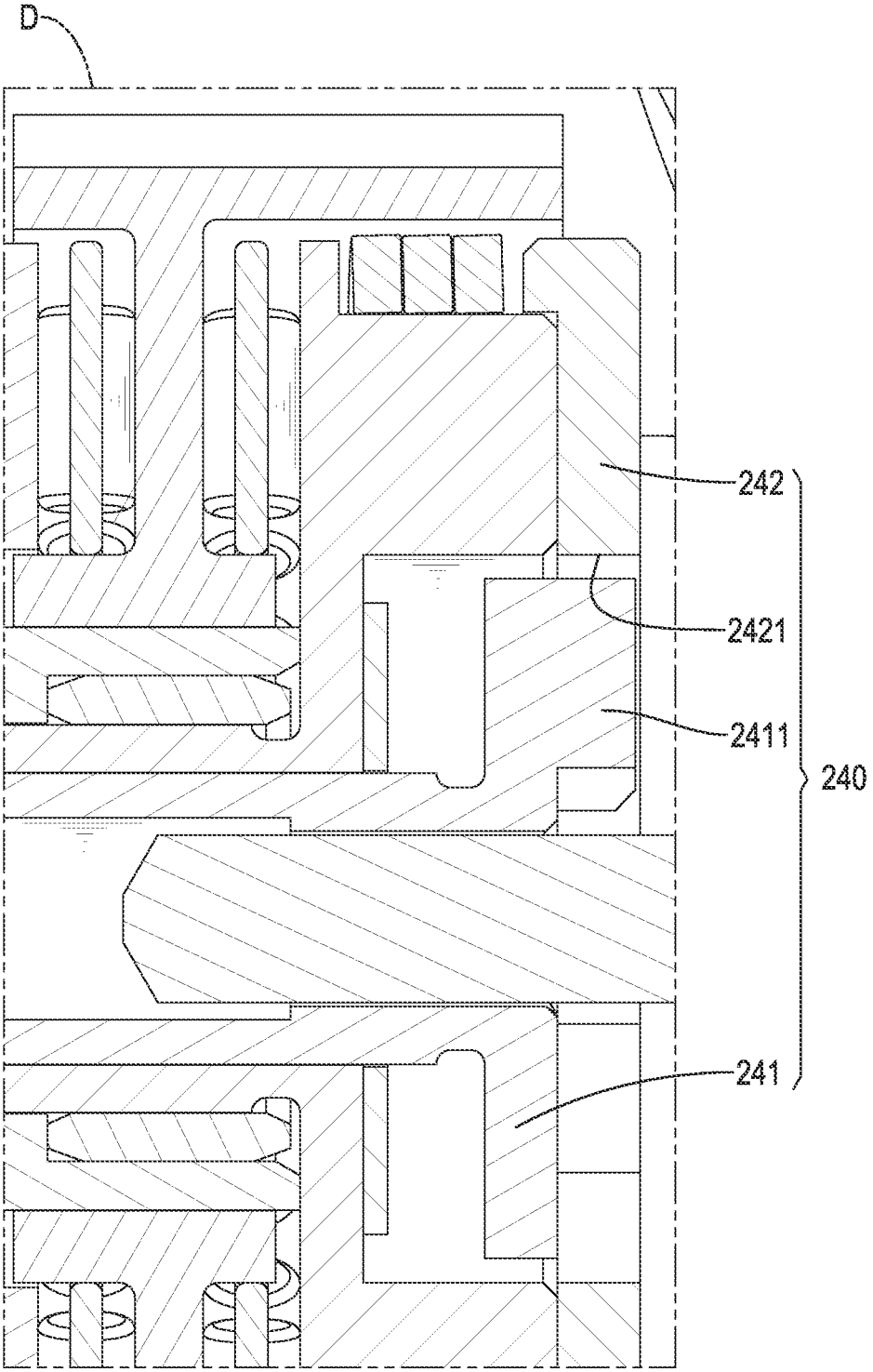
FIG. 4B is a further enlarged and operational cross sectional side view of the power tool in FIG. 4 at a rectangular area D.

With reference to FIGS. 4, 4A, and 4B, when the threaded spindle 131 is inserted into the rivet nut N1 and is pressed by the rivet nut N1, the threaded spindle 131, the pulling shaft 133 and the connecting shaft 132 are moved along the axial direction I1 away from the muzzle of the barrel 111, and the first pre-fastening detecting member 171 is moved to align with the second pre-fastening detecting member 172. Then the second pre-fastening detecting member 172 sends a signal to the control circuit to automatically start the motor 140. After the motor 140 is started, the connecting shaft 132 is rotated by the shaft-driven gear set 220 to enable the connecting shaft 132 and the threaded spindle 131 to rotate relative to the ball screw 150, and the threaded spindle 131 is fastened in the rivet nut N1. At the same time, the ball nut 210 is rotated by the nut-driven gear set 230 to enable the ball screw 150 to move along the axial direction I1 away from the muzzle of the barrel 111. Then the limiting mount 191 and the connecting shaft 132 are pushed to move away from the muzzle of the barrel 111, and the spring sleeve 135 is also moved in the same direction by the second spring 137. Finally, after the motor 140 completes the preset number of revolutions and completes the pre-fastening process of the rivet nut N1, the motor 140 stops automatically.

Figure 5:
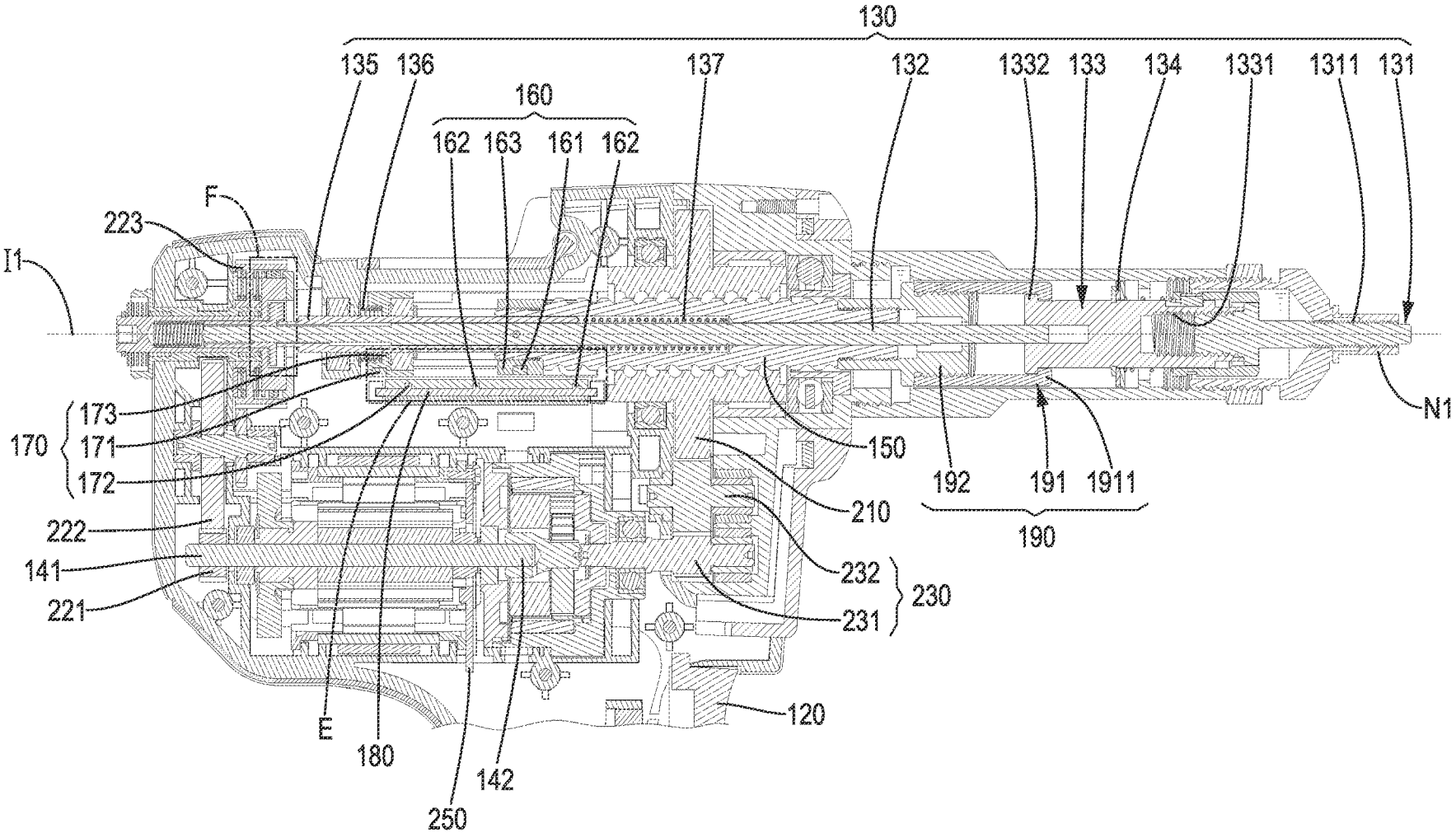
FIG. 5 is another enlarged and operational cross sectional side view of the power tool in FIG. 1.
Figure 5A:
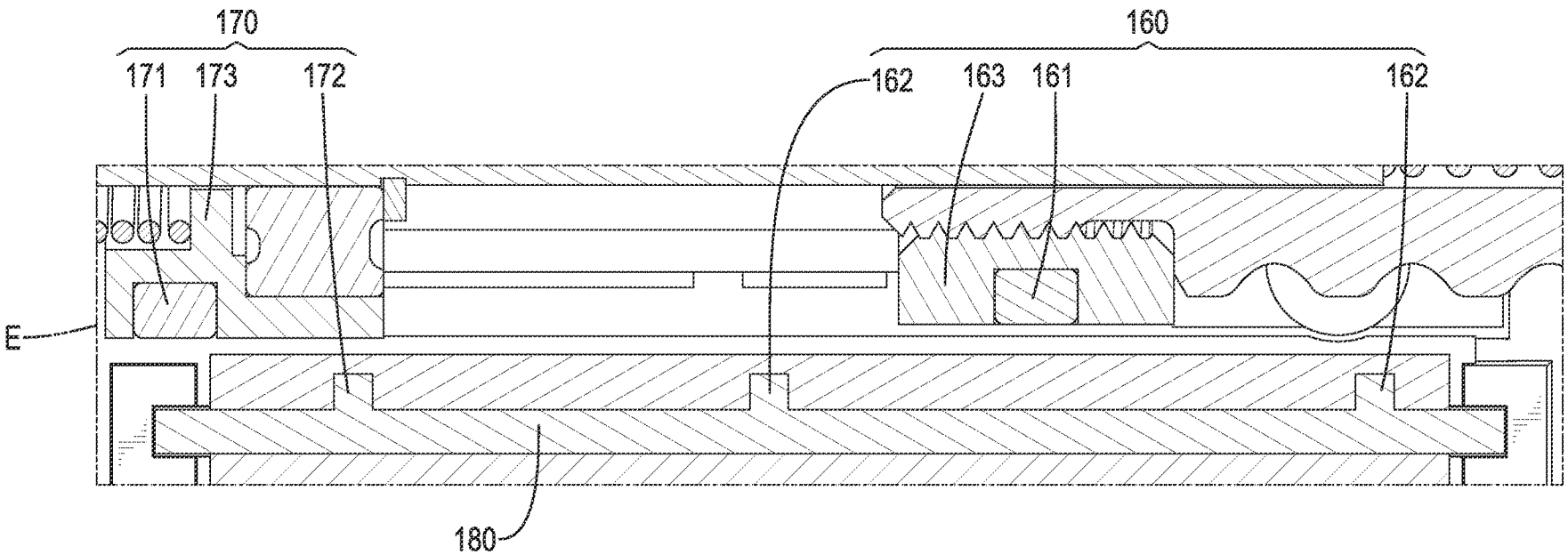
FIG. 5A is a further enlarged and operational cross sectional side view of the power tool in FIG. 5 at a rectangular area E.
Figure 5B:
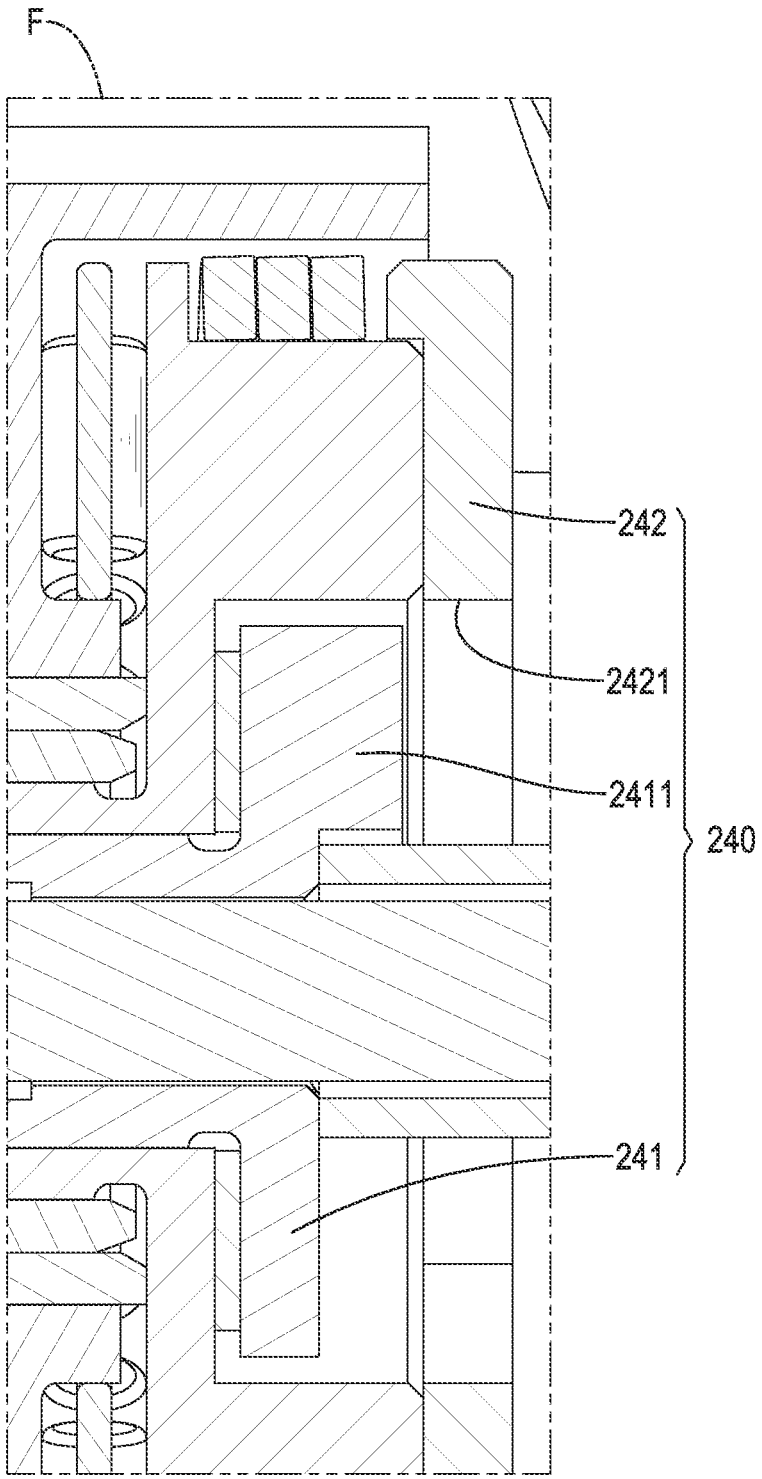
FIG. 5B is a further enlarged and operational cross sectional side view of the power tool in FIG. 5 at a rectangular area F.

With reference to FIGS. 5, 5A, and 5B, after the pre-fastening process, the spring sleeve 135 is moved away from the muzzle of the barrel 111 to push against the joint bushing 241, so that the joint bushing 241 is separated from the blocking slice 242, and the limiting mount 191 retreats to a position where it abuts against the flange 1332 of the pulling shaft 133.

Under the above-mentioned condition, the trigger 120 can be pressed by a user to start the motor 140 manually, and the connecting shaft 132 does not rotate after the motor 140 is started since the joint bushing 241 is separated from the blocking slice 242. The threaded spindle 131 also does not rotate. The motor 140 drives the ball nut 210 rotating to enable the ball screw 150 to move away from the muzzle of the barrel 111, the pulling shaft 133 is moved backward along the axial direction I1 by the limiting mount 191 to pull the rivet nut N1, and the deformed portion of the rivet nut N1 is compressed to deform to fix on an object. The control circuit can determine whether the fastening process of the rivet nut N1 has been completed via the number of revolutions of the motor 140, and the motor 140 can be reversed after the fastening process of the rivet nut N1 is completed. Then the ball screw 150 is moved toward the muzzle of the barrel 111 along the axial direction I1 to release the pressure on the second spring 137 without pushing against the spring sleeve 135. A clutch spring of the clutch 240 can push the joint bushing 241 to reset and couple with the blocking slice 242. At this time, the connecting shaft 132 can be reversed by the motor 140, and can automatically withdraw from the rivet nut N1. Finally, the ball screw 150 drives the first position-sensing element 161 to align with the frontmost second position-sensing element 162, and the corresponding second position-sensing element 162 sends a signal to the control circuit to confirm that the ball screw 150 returns to the original position, the motor 140 can automatically stop, and the threaded spindle 131 can be completely withdrawn from the rivet nut N1.

Please note that, if a moving stroke of the ball screw 150 is too long during the operation, so that the first position-sensing element 161 is aligned with the rearmost second position-sensing element 162, the corresponding second position-sensing element 162 sends a signal to the control circuit to indicate that the position of the ball screw 150 is abnormal. The motor 140 will be stopped at this time, thereby preventing damage or danger of the power tool 100 and improving the safety of the power tool 100.

According to the above-mentioned features and structural relationship of the power tool 100 of the present invention, since the power tool 100 is equipped with the pre-fastening module 170 and the position sensing module 160, there is no need to set multiple clutches or use high-cost micro switches, thereby reducing the complexity of the structure and reducing the cost.

Even though numerous characteristics and advantages of the present invention have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A power tool for a rivet nut, the power tool comprising:
a body;
a trigger disposed on the body;
a motor disposed in the body;
a shaft set disposed in the body, driven by the motor, and having
an axial direction;
a threaded spindle having at least one part extended out of the body to screw with the rivet nut; and
a connecting shaft connected to the threaded spindle to transmit a rotational driving force of the motor;
a ball screw mounted around the connecting shaft;
a position sensing module having
a first position-sensing element moved with the ball screw in the axial direction; and
at least one second position-sensing element located on a moving path of the ball screw to sense the first position-sensing element to confirm a position of the ball screw; and
wherein when the trigger is pressed, the motor is started, the threaded spindle pulls the rivet nut to be fixed on an object and withdraws from the rivet nut, and the ball screw moves to align the first position-sensing element with the at least one second position-sensing element to confirm that the ball screw returns to an original position, and the motor stops automatically;
a pre-fastening module having
a first pre-fastening detecting member moved with the connecting shaft in the axial direction; and
a second pre-fastening detecting member located on the moving path of the ball screw;
wherein when the threaded spindle is inserted into the rivet nut and is pressed to enable the connecting shaft to move inward the body, the first pre-fastening detecting member is moved to align with the second pre-fastening detecting member to automatically start the motor, the threaded spindle is rotated relative to the rivet nut by the motor, and the motor is automatically stopped after the rivet nut is pre-fastened on the threaded spindle.

2. The power tool as claimed in claim 1, wherein
each of the first position-sensing element and the first pre-fastening detecting member has a magnet structure; and
each of the at least one second position-sensing element and the second pre-fastening detecting member has a Hall element structure.

3. The power tool as claimed in claim 1, wherein
the power tool has a rotor-position sensor to detect the number of revolutions of the motor;
when the motor rotates for a preset number of revolutions, the motor stops automatically to complete a pre-fastening process of the rivet nut.

4. The power tool as claimed in claim 1, wherein
the power tool has a mounting board disposed in the body below the connecting shaft;
the at least one second position-sensing element and the second pre-fastening detecting member are disposed on the mounting board at spaced intervals; and
the second pre-fastening detecting member is farther away from the threaded spindle in the axial direction than the at least one second position-sensing element.

5. The power tool as claimed in claim 4, wherein
the position sensing module has two said second position-sensing elements;
the two said second position-sensing elements are disposed on the mounting board at a spaced interval; and
the second pre-fastening detecting member is farther away from the threaded spindle in the axial direction than the two said second position-sensing elements.

6. The power tool as claimed in claim 1, wherein
the position sensing module has a position-sensing ring; and
the position-sensing ring is screwed on the ball screw for disposing the first position-sensing element.

7. The power tool as claimed in claim 6, wherein
the pre-fastening module has a pre-fastening detecting ring; and
the pre-fastening detecting ring is mounted around the connecting shaft for disposing the first pre-fastening detecting member.

8. The power tool as claimed in claim 7, wherein
the power tool has a ball nut; and
the ball nut is disposed in the body, is mounted around the ball screw, and is disposed between the position-sensing ring and the threaded spindle.

9. The power tool as claimed in claim 8, wherein
the power tool has
a shaft-driven gear set disposed in the body and connected to the connecting shaft; and
a nut-driven gear set disposed in the body and connected to the ball nut; and
the motor has two output ends, one of the two output ends is connected to the shaft-driven gear set, and the other one of the two output ends is connected to the nut-driven gear set.

10. The power tool as claimed in claim 9, wherein
the power tool has a clutch; and
the clutch is disposed in the body and has
a joint bushing mounted around the connecting shaft, limited in rotation with the connecting shaft, and having an engaging block; and a blocking slice mounted around the joint bushing, rotated with the shaft-driven gear set, and having an engaging hole corresponding to the engaging block;

when the engaging block engages with the engaging hole, the motor drives the shaft-driven gear set to rotate the connecting shaft via the blocking slice and the joint bushing.

* * * * *